US005211766A

United States Patent [19]

Panchanathan

[11] Patent Number: 5,211,766

[45] Date of Patent: May 18, 1993

[54] ANISOTROPIC NEODYMIUM-IRON-BORON PERMANENT MAGNETS FORMED AT REDUCED HOT WORKING TEMPERATURES

[75] Inventor: Viswanathan Panchanathan, Anderson, Ind.

[73] Assignee: General Motors Corporation, Detroit, Mich.

[21] Appl. No.: 823,097

[22] Filed: Jan. 21, 1992

[51] Int. Cl.[5] ..... H01F 1/02

[52] U.S. Cl. ..... 148/101; 148/104; 419/11; 419/12; 419/14; 419/15; 419/16; 419/17

[58] Field of Search ..... 148/101, 102, 104; 419/11, 12, 14, 15, 16, 17

[56] References Cited

U.S. PATENT DOCUMENTS 4,792,367 12/1988 Lee ..... 148/104
4,802,931 2/1989 Croat ..... 148/302
4,952,239 8/1990 Tokunaga et al. ..... 148/302
4,983,232 1/1991 Endoh et al. ..... 148/302

FOREIGN PATENT DOCUMENTS 0306599 3/1989 European Pat. Off. ..... 148/101

*Primary Examiner*—John P. Sheehan
*Attorney, Agent, or Firm*—George A. Grove

[57] ABSTRACT

Additions of carbon or tantalum ranging between about 0.1 to about 0.15 weight percent are added to an iron-rare earth metal permanent magnet alloy. The permanent magnet alloy contains the magnetic phase consisting of $Fe_{14}Nd_2B$ (or the equivalent) tetragonal crystals, which is primarily based on neodymium and/or praseodymium, iron and boron The isotropic melt-spun ribbons of the preferred alloy are characterized by generally improved magnetic properties. The anisotropic magnetic bodies formed from these ribbons are hot worked at temperatures substantially lower than the conventional alloy which does not contain the carbon or tantalum additions, with an improvement in magnetic properties observed.

4 Claims, 3 Drawing Sheets

ANISOTROPIC NEODYMIUM-IRON-BORON PERMANENT MAGNETS FORMED AT REDUCED HOT WORKING TEMPERATURES

The present invention generally relates to the making of a magnetically anisotropic composition based primarily on iron, neodymium and/or praseodymium, and boron. More specifically, this invention relates to the addition of a small amount of either carbon or tantalum to the alloy composition, wherein the additions not only improve the magnetic properties of the annealed, melt-spun ribbons formed from the alloy composition but also reduce the temperature required for hot working of a body formed from such a composition.

BACKGROUND OF THE INVENTION

Permanent magnets based on compositions containing iron, neodymium and/or praseodymium, and boron are known and in commercial usage. Such permanent magnets contain as an essential magnetic phase grains of tetragonal crystals in which the proportions of, for example, iron, neodymium and boron are exemplified by the empirical formula $Nd_2Fe_{14}B$. These magnet compositions and methods for making them are described by Croat in U.S. Pat. No. 4,802,931 issued Feb. 7, 1989. The grains of the magnetic phase are surrounded by a second phase that is typically rare earth-rich, as an example neodymium-rich, as compared with the essential magnetic phase. It is known that magnets based on such compositions may be prepared by rapidly solidifying (such as by melt spinning) a melt of the composition to produce fine grained, magnetically isotropic platelets of ribbon-like fragments. Magnets may be formed from these isotropic particles by practices which are known Although the magnets formed from these isotropic ribbons are satisfactory for many applications, there is always a desire to improve the magnetic properties of these isotropic, melt-spun ribbons.

Lee, U.S. Pat. No. 4,782,367, issued Dec. 20, 1988, went on to demonstrate that the melt-spun isotropic powder can be suitably hot pressed and hot worked by plastically deforming to form high strength anisotropic permanent magnets. Such magnets have excellent magnetic properties. Typically, the hot working of these anisotropic magnetic bodies is accomplished at a temperature of about 1500° F. or higher.

It would be desirable to provide a method for hot working these anisotropic magnetic bodies at lower temperatures since any reduction in the temperature will significantly enhance the life of the machinery, particularly the punches and dies, employed during the hot working, as well as also generally make the processing of such magnets simpler In addition, another advantage associated with hot working of these magnets at lower temperatures is that grain growth is decreased within the alloy during the hot pressing operation, resulting in a more homogeneous composition characterized by uniform magnetic properties throughout.

Therefore, although these prior art methods have worked satisfactorily to produce anisotropic magnetic bodies, it would be desirable to provide a means for hot working these bodies at reduced temperatures without any loss in magnetic properties In addition, as previously mentioned, it would be desirable if such a means concurrently enhanced the magnetic properties of the melt-spun material also.

SUMMARY OF THE INVENTION

It is therefore an object of this invention to provide anisotropic magnetic bodies of a composition that has as its magnetic constituent the tragonal crystal phase $RE_2TM_{14}B$ which is primarily based on neodymium and/or praseodymium, iron and boron, with small elemental additions of either carbon or tantalum being added to the composition to enable the hot working of such a composition at reduced temperatures as compared to conventional compositions which do not include the elemental additions.

It is a further object of this invention that such additions of carbon or tantalum also improve the magnetic properties of the isotropic melt-spun ribbons of material used to form the hot worked, anisotropic magnetic bodies.

In accordance with a preferred embodiment of this invention, these and other objects and advantages are accomplished as follows.

According to the present invention, there is provided a means for hot working, at reduced temperatures, an anisotropic iron-rare earth metal permanent magnet, containing the magnetic phase consisting of $Fe_{14}Nd_2B$ (or the equivalent) tetragonal crystals, by the addition of from about 0.1 to about 0.15 weight percent of either carbon or tantalum to the magnet composition. The addition of this small amount of either element does not cause a loss in the magnetic properties, yet permits the hot working of these magnetic bodies to be performed at lower temperatures, for example about 100° F. or more below the optimum hot working temperatures required for magnetic compositions that do not include the preferred elemental additions.

Further, the addition of either carbon or tantalum in accordance with this invention to the magnet alloy composition results in improved magnetic properties in the annealed melt-spun ribbon, which is used to subsequently form the anisotropic hot worked bodies. The isotropic melt-spun ribbons having the enhanced properties can be used in many applications which do not require the anisotropic properties characteristic of the hot worked bodies.

Generally, the alloy compositions of this invention comprise, on an atomic percentage basis, about 40 to 90 percent of iron or mixtures of cobalt and iron, about 10 to 40 percent of rare earth metal that necessarily includes neodymium and/or praseodymium, and at least one-half percent boron. Preferably, iron makes up at least about 40 atomic percent of the total composition and neodymium and/or praseodymium make up at least about six atomic percent of the total composition. Also, preferably the boron content is in the range of about 0.5 to about 10 atomic percent of the total composition, but the total boron content may suitably be higher than this depending on the intended application. It is further preferred that iron make up at least 60 atomic percent of the non-rare earth metal content and that the neodymium and/or praseodymium make up at least about 60 atomic percent of the rare earth content. The small additions of either carbon or tantalum are added to this composition.

For convenience, the preferred compositions have been expressed in terms of atomic proportions which are readily converted to weight proportions for preparing the composition mixtures A more particular composition, in weight percentages, would include about 26 to 32 percent rare earth wherein neodymium is at least approximately 90 percent, preferably 95 percent, of this constituent and praseodymium and other rare earths the balance, about 0.7 to 1.1 percent boron, about 2 to 16 percent cobalt, about 0.1 to 0.15 percent carbon or tantalum, and the balance essentially iron However, the compositions of the various iron, rare earth, boron and cobalt constituents can vary greatly within the preferred atomic ranges specified above.

Generally, magnetic bodies of this composition are preferably formed by starting with such a composition that has been suitably rapidly solidified to produce an amorphous material or a finely crystalline material in which the grain size is less than about 400 nanometers in largest dimension. It is most preferred that the rapidly solidified material be amorphous, or if extremely finely crystalline, have a grain size smaller than about 20 nanometers. Such material may be produced, for example, by melt spinning. The addition of either carbon or tantalum in accordance with this invention to the magnet alloy composition results in improved magnetic properties in the annealed isotropic melt-spun ribbon.

The preferred rapidly solidified materials are then hot pressed in a die at temperatures on the order of about 1400° F. (which is significantly lower than conventional compositions which do not include the preferred elemental additions of this invention) and at a sufficient pressure and duration to form a fully dense material that has magnetic coercivity at room temperature in excess of about 1,000 Oersteds and preferably in excess of about 5,000 Oersteds. Typically when melt-spun material finer than about 20 nanometers in grain size is heated at such an elevated temperature for a period of a minute or so and hot pressed to full density, the resultant body is a permanent magnet. Further, the magnetic body is slightly magnetically anisotropic (meaning that the magnetic body has a preferred direction of magnetization). If the particulate material has been held at the hot pressing temperature for a suitable period of time, it will then have a grain size in the range of about 20 to about 500 nanometers, preferably abut 20 to 100 nanometers.

If the hot pressed body is then hot worked, that is, plastically deformed at such an elevated temperature so as to deform the grains, the resultant product displays appreciable magnetic anisotropy. If suitably practiced, the high temperature working produces a fine platelet microstructure, generally without affecting an increase in grain size above 500 nanometers. Care is taken to cool the material before excessive grain growth and loss of coercivity occurs. The preferred direction of magnetization of the hot worked product is typically parallel to the direction of pressing and transverse to the direction of plastic flow. A significantly higher energy product is obtained when the body is magnetized transverse to the direction of plastic flow. It is not uncommon for the hot worked product to have an energy product of about 30 MegaGaussOersted or higher.

In accordance with the preferred teachings of this invention, the addition of about 0.1 to 0.15 weight percent of either carbon or tantalum to the magnetic composition enhances the magnetic properties in the annealed melt-spun ribbon while also enabling the magnetic compositions to be hot worked at a substantially lower temperature than the temperature required to optimize the magnetic properties in a conventional material. Generally, the hot working temperature can be reduced by about 100° F. or more, without a reduction in the resulting magnetic properties of the composition, which would be expected with conventional compositions.

Particularly advantageous features of this invention include the enhancement of the magnetic properties in the annealed melt-spun ribbon which enables the formation of stronger isotropic magnets. In addition, the reduced hot working temperatures make simpler the processing of these types of anisotropic magnets. The use of lower temperatures significantly reduces the wear and tear on the dies and punches employed during the hot working steps, thereby enhancing the overall production capability of these types of magnets.

Other objects and advantages of this invention will be better appreciated from the following detailed description.

BRIEF DESCRIPTION OF THE DRAWINGS

Reference will be made to the accompanying drawing wherein.

DETAILED DESCRIPTION OF THE INVENTION

Figure 1:
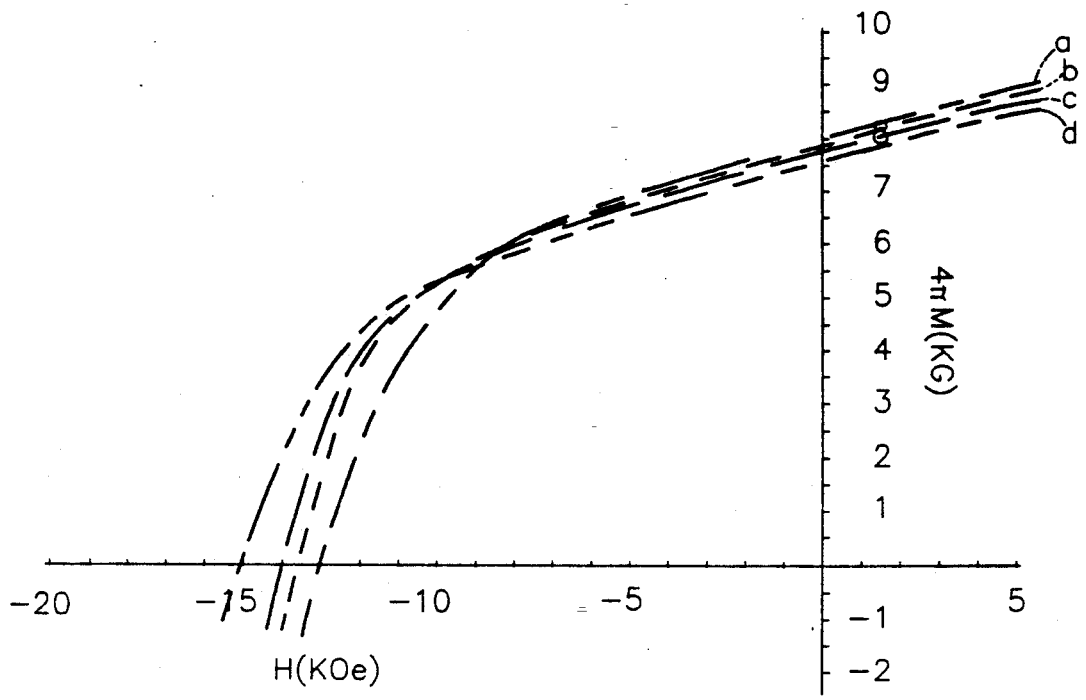
FIG. 1 illustrates demagnetization curves for melt-spun ribbons annealed at various temperatures and formed from an iron-neodymium-boron type magnet composition having a preferred carbon addition of about 0.1 weight percent in accordance with this invention.

Means are provided for enhancing the magnetic properties of annealed melt-spun ribbon while also reducing the hot working temperatures required for formation of an anisotropic iron-rare earth metal permanent magnet from the ribbons by the addition of from about 0.1 to about 0.15 weight percent of either carbon or tantalum to the magnet composition.

The preferred compositions of this invention comprise a suitable transition metal component, a suitable rare earth component and boron, as well as the small additions of either carbon or tantalum, and are generally represented by the empirical formula RE2TM14B. The preferred compositions as stated previously consist of, on an atomic percentage basis, about 40 to 90 percent of iron or mixtures of cobalt and iron, with the iron preferably making up at least 60 percent of the non-rare earth metal content; about 10 to 40 percent of rare earth metal that necessarily includes neodymium and/or praseodymium, with the neodymium and/or praseodymium preferably making up at least about 60 percent of the rare earth content; and at least one-half percent boron. Preferably, iron makes up at least about 40 atomic percent of the total composition and the neodymium and/or praseodymium make up at least about six atomic percent of the total composition. Also, preferably, the boron content is in the range of about 0.5 to about 10 atomic percent of the total composition, but the total boron content may suitably be higher than this depending on the intended application for the magnetic composition The useful permanent magnet compositions suitable for practice with this invention are specified in U.S. Pat. No. 4,802,931 to Croat issued Feb. 7, 1989.

Specific compositions which have been useful in preparing hot worked, anisotropic permanent magnets of this type, in corresponding weight percentages, are as follows and contain the magnetic phase consisting of $Fe_{14}Nd_2B$ (or the equivalent) tetragonal crystals: about 26 to 32 percent rare earth (wherein at least about 95 percent of this constituent is neodymium and the remainder is essentially praseodymium); about 0.7 to about 1.1 percent boron; about 0.1 to about 0.15 percent carbon or tantalum; and the balance being iron with cobalt being substituted for the iron in some instances from about 2 to about 16 percent. In addition, gallium may also be added in an amount of between about 0.55 and 0.75 percent.

However, it is to be understood that the teachings of this invention are applicable to the larger family of compositions as described previously in atomic percentages and will be referred to generally as an iron-neodymium-boron composition.

Alloy ingots of the preferred composition having the carbon or tantalum additions were melted by induction heating under a dry, substantially oxygen-free argon atmosphere to form a uniform molten composition. While under such an inert atmosphere and at a pressure of about 2 to 3 psig, the molten composition was ejected down through a ceramic nozzle onto the perimeter of a rotating wheel. The velocity of the wheel was sufficient so that when the melt struck the wheel, it solidified substantially instantaneously to form ribbon fragments which were thrown from the wheel. The magnetic properties of the alloy will vary depending on the wheel speed employed, as discussed more fully later. The fragments were collected and determined to be substantially amorphous.

The preferred melt-spun ribbons may be annealed at an appropriate temperature, such as about 1050° F. to about 1185° F., and formed into useful magnetic materials by known practices. The preferred alloy compositions of this invention, having the additions of either carbon or tantalum, exhibited improved magnetic properties in the annealed melt-spun ribbons, as compared to conventional alloys which do not include the carbon or tantalum additions, as determined by Vibrating Sample Magnetometer (VSM) tests described more fully later. In order to test the melt-spun ribbons using the VSM, crushed, powdered samples of the melt-spun ribbons weighing approximately 0.65 grams were prepared. The specific examples which follow illustrate this improvement.

The substantially amorphous, melt-spun iron-neodymium-boron ribbons were then milled to a powder and then heated to an elevated temperature in a die and compacted between upper and lower punches so as to form a substantially fully dense, flat cylindrical plug one inch in diameter by about 5/8 inch in thickness. The still hot fully densified body was then transferred to a larger die, also at an elevated temperature, in which it was die upset to form a cylindrical plug about 1⅜ inch in diameter by about ¼ inch in thickness The resulting cylindrical plug was hard and strong and characterized by a density of about 7.5 grams per cubic centimeter, which is substantially full density.

The actual temperatures employed to hot press and hot work the bodies varied and will be discussed more fully in the specific examples below Generally, the hot pressing and hot working are accomplished at the same elevated temperature, although this is not necessary.

This hot worked, die upset body was an unmagnetized composition that had appreciable magnetic coercivity and was magnetically anisotropic. By die upsetting, the grains in the body are flattened and aligned with their major dimension lying transverse to the direction of pressing. The maximum dimensions of the grains were in the range of about 100 to 300 nanometers. The grains contained tetragonal crystals in which the proportions of iron, neodymium and boron were in accordance with the formula $Nd_2Fe_{14}B$.

The magnetic properties of the hot worked, anisotropic body, formed in accordance with this invention, were determined using conventional Hysteresis Graph Magnetometer (HGM) tests. The sample was placed such that its axis parallel to the direction of alignment was parallel to the direction of the field applied by the HGM. The sample was then magnetized to saturation and then demagnetized.

Figure 2:
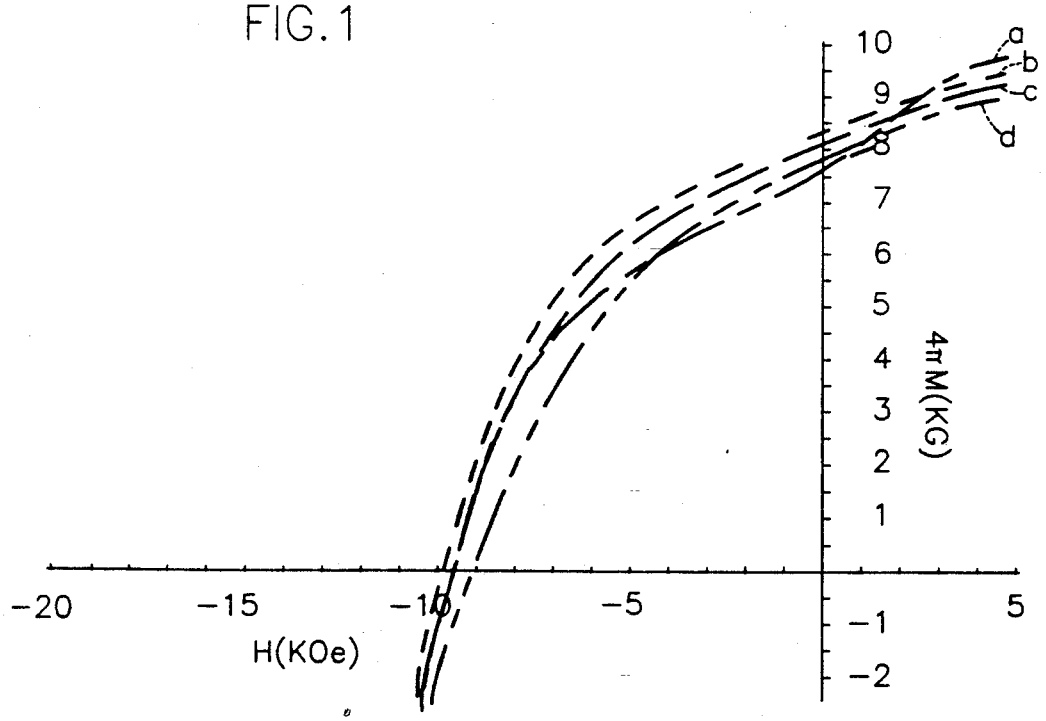
FIG. 2 illustrates demagnetization curves for melt-spun ribbons formed from an iron-neodymium-boron type magnet having a preferred carbon addition of about 0.1 weight percent in accordance with this invention, which have been melt spun at various wheel speeds.
Figure 3:
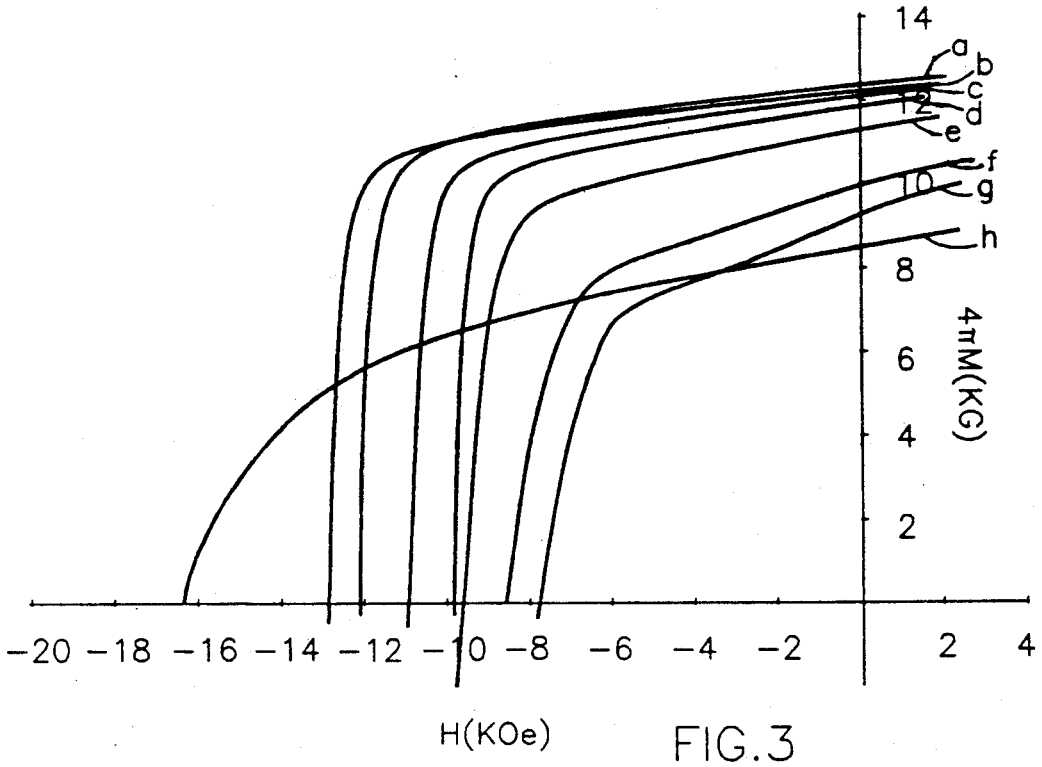
FIG. 3 illustrates demagnetization curves for the iron-neodymium-boron type magnet represented in FIG. 1 which has been hot worked at various temperatures.
Figure 4:
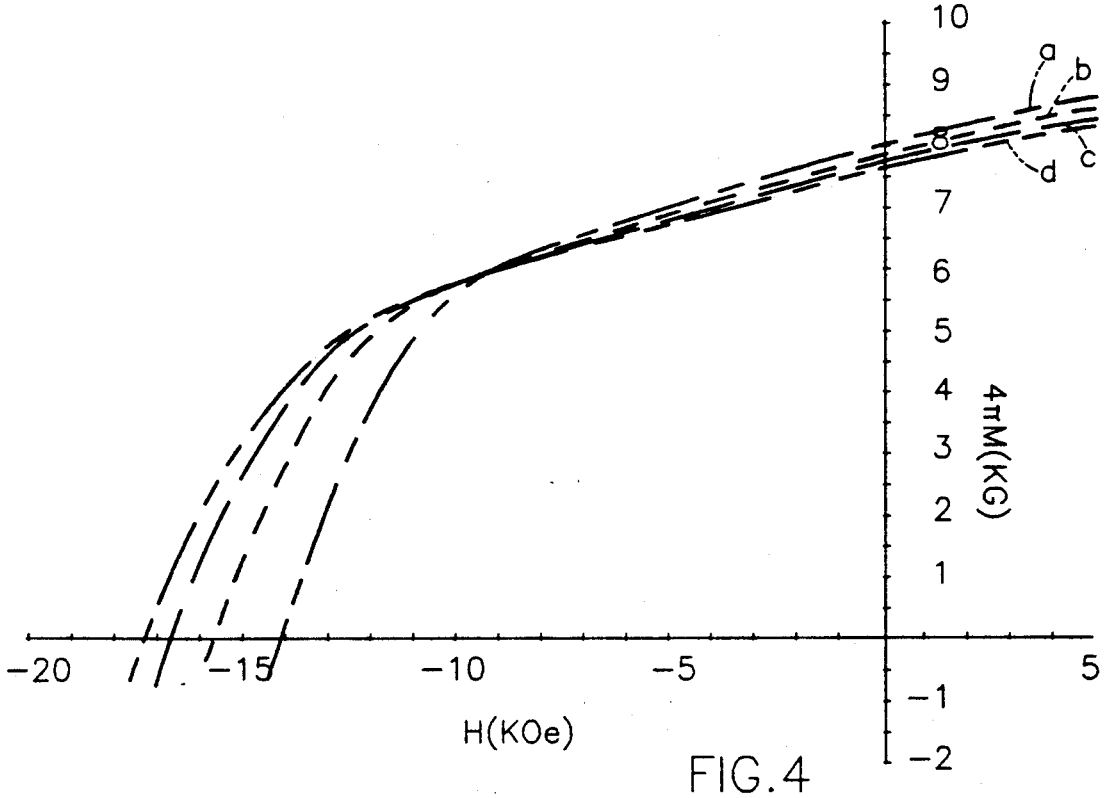
FIG. 4 illustrates demagnetization curves for melt-spun ribbons annealed at various temperatures formed from an iron-neodymium-boron type magnet which includes a preferred tantalum addition of about 0.15 weight percent in accordance with this invention.

The second quadrant demagnetization plots are shown in FIGS. 1 through 5 [$4\pi M$ in kiloGauss versus coercivity (H) in kiloOersteds] for the various samples. FIGS. 1, 2 and 4 for the melt-spun ribbons were determined using VSM techniques, and FIGS. 3 and 5 for the hot worked magnetic bodies were determined using HGM techniques, as described above.

Results of the tests indicate that the addition of the small amount of either carbon or tantalum to the magnetic composition does not cause a loss in the magnetic properties yet permits the hot working of these magnetic bodies to be performed at reduced temperatures, for example about 1400° F., as compared to conventional magnetic compositions which do not contain these additions. A hot working temperature of about 1400° F. is about 100° F. or more below the optimum hot working temperature for the magnetic compositions that do not include the elemental additions. Specific examples of such are as follows.

COMPARATIVE EXAMPLE 1

For comparative purposes, a conventional alloy which did not include the additions of carbon or tantalum in accordance with this invention was first tested. The nominal composition of this conventional alloy, in weight percentages, was about 30.5 percent rare earth (wherein at least about 95 percent of this constituent is neodymium and the remainder essentially praseodymium), about 2.5 percent cobalt, about 1.0 percent boron and a balance of iron. The magnetically isotropic melt-spun ribbons were produced as described above. The remanence, coercivity and energy product of the melt-spun ribbons were determined using VSM techniques.

The optimum magnetic properties for this conventional composition occur at an annealing temperature of about 1075° F., as determined by conventional practices. Average values for magnetic properties obtained at this annealing temperature are about 7.4 kiloGauss for remanence, 17.5 kiloOersteds for coercivity, and an energy product of about 11.5 MegaGaussOersteds.

EXAMPLE 2

In comparison, a magnetic alloy having the same composition as in Comparative Example 1 except that 10 percent of the boron content, i.e., about 0.1 weight percent, has been substituted with carbon. Therefore, the nominal composition of this preferred alloy, in weight percentages, was about 30.5 percent rare earth, about 2.5 percent cobalt, about 0.9 percent boron, about 0.1 percent carbon and a balance of iron. This preferred alloy was melt spun to form magnetically isotropic ribbons which were then annealed at various temperatures so as to optimize magnetic properties.

The demagnetization curves for these melt-spun ribbons which were annealed at various temperatures formed from the preferred iron-neodymium-boron type magnet composition having 0.1 weight percent carbon are illustrated in FIG. 1.

In FIG. 1, curve "a" represents an annealing temperature of about 1075° F., curve "b" represents an annealing temperature of about 1112° F., curve "c" represents an annealing temperature of about 1148° F., and curve "d" represents an annealing temperature of about 1184° F. The optimum magnetic properties for this preferred composition having the 0.1 weight percent carbon addition were determined to occur at an annealing temperature of about 1075° F. (curve "a"), which is not surprising since this is the optimal annealing temperature for the conventional alloy in Comparative Example 1.

Average values for the magnetic properties for the melt-spun ribbons having the carbon addition, at an annealing temperature of about 1075° F., are about 7.96 kiloGauss for remanence, 14.1 kiloOersteds for coercivity, and an energy product of about 13.4 MegaGaussOersteds. As compared to the conventional alloy of Comparative Example 1, the remanence of 7.96 kiloGauss (compared to 7.4) and energy product of 13.4 MegaGaussOersteds (compared to 11.5) have improved in the preferred alloy having the carbon addition, while the coercivity of about 14.1 kiloOersteds (compared to 17.5) decreased. For many applications, all that is required is a high remanence and energy product, so long as the coercivity is sufficient, which is the case with the preferred alloy of this example.

A carbon addition of up to about 20 percent of the boron content, or about 0.2 weight percent of the alloy composition, would be useful in improving these magnetic properties without causing much loss in other properties such as by reducing the Curie temperature for the magnet. It is preferred that the carbon content range between about 0.1 and 0.15 weight percent. Although in the example the carbon is substituted for a portion of the boron content, this is not necessary, i.e., the carbon may be in addition to the normal boron content.

COMPARATIVE EXAMPLE 3

Again, for comparative purposes, a conventional alloy not having the additions of carbon or tantalum in accordance with this invention was tested for determination of the relationship between magnetic properties and the melt spinning wheel speed. The nominal composition of this conventional alloy, in weight percentages, was about 27.5 percent rare earth (wherein at least about 95 percent of this constituent is neodymium and the remainder essentially praseodymium), about 5.0 percent cobalt, about 1.0 percent boron and a balance of iron. The magnetically isotropic melt-spun ribbons were produced by varying the wheel speed used during the melt spinning operation. The remanence in kiloGauss ($B_r$), coercivity in kiloOersteds (H) and energy product in MegaGaussOersteds($BH_{max}$) of the melt-spun ribbons were determined using VSM techniques for the various wheel speeds and are listed below in Table I.

TABLE 1

| Wheel Speed (m/sec) | $B_r$ | H | $BH_{max}$ |
|---|---|---|---|
| 17 | 7.9 | 8.77 | 11.57 |
| 18 | 7.81 | 8.72 | 10.78 |
| 19 | 7.69 | 8.55 | 9.79 |
| 20 | 8.01 | 9.04 | 11.84 |
| 21 | 8.05 | 9.33 | 12.29 |
| 22 | 6.58 | 8.69 | 7.12 |

The wheel speed affects the rate of cooling of the melt-spun ribbons. The magnetic properties of the melt-spun ribbons which are quenched above the optimum wheel speed can be enhanced by annealing, as evidenced by comparison with Examples 1 and 2.

The optimum magnetic properties for this conventional composition occurred at a wheel speed of about 21 meters per second. At this speed, the magnetic properties were determined to be about 8.05 kiloGauss for remanence, 9.33 kiloOersteds for coercivity, and an energy product of about 12.29 MegaGaussOersteds.

EXAMPLE 4

The alloy of Comparative Example 3, which includes 0.1 weight carbon substituted for 10 percent of the boron content, was also melt spun at various wheel speeds. Demagnetization curves determined by VSM techniques for the various wheel speeds are illustrated in FIG. 2, with curve "a" representing a wheel speed of about 20 meters per second (m/sec), curve "b" representing a wheel speed of about 19 m/sec, curve "c" representing a wheel speed of about 18 m/sec, and curve "d" representing a wheel speed of about 17 m/sec. The remanence in kiloGauss ($B_r$), coercivity in kiloOersteds (H) and energy product in MegaGaussOersteds ($BH_{max}$) of the melt-spun ribbons for the various wheel speeds are listed below in Table II.

TABLE II

| Wheel Speed (m/sec) | $B_r$ | H | $BH_{max}$ |
|---|---|---|---|
| 17 | 7.88 | 9.05 | 11.63 |
| 18 | 8.19 | 9.58 | 13.10 |
| 19 | 8.31 | 9.72 | 13.62 |
| 20 | 7.7 | 9.6 | 11.06 |

The optimum magnetic properties for this preferred composition having a 0.1 weight percent carbon addition occurred at a wheel speed of about 19 meters per second. At this speed, the magnetic properties were determined to be about 8.31 kiloGauss for remanence (compared to 8.04 optimum in Comparative Example 3), 9.72 kiloOersteds for coercivity (compared to 9.33 optimum in Example 3), and an energy product of about 13 62 MegaGaussOersteds (compared to 12.29 optimum in Comparative Example 3).

The addition of the 0.1 weight percent carbon to the conventional alloys described in Comparative Examples 1 and 3 again result in improved magnetic properties. Also, these improved magnetic properties were obtained at a lower wheel speed during the melt spinning operation.

COMPARATIVE EXAMPLE 5

The conventional composition of Comparative Example 1 was hot pressed and plastically deformed by hot working at various temperatures, i.e., about 1400° F., 1440° F., 1480° F. and 1520° F. The maximum magnetic properties are obtained at a temperature of about 1480° F. to about 1520° F. Magnetic remanence was determined to be about 12.1 kiloGauss, coercivity was about 14.1 kiloOersteds, and energy product was about 35.5 MegaGaussOersteds. At 1440° F., the magnetic properties begin to decrease, and at 1400° F. the corresponding magnetic properties have decreased significantly, i.e., a remanence of about 11.7 kiloGauss and an energy product of about 32.5 MegaGaussOersteds.

It is seen that the optimum hot working temperature for these types of conventional alloys is at least about 1480° F., preferably 1520° F., or higher.

EXAMPLE 6

One of the preferred compositions having 0.1 weight percent carbon of Example 2 was also hot pressed and hot worked at various temperatures. Generally, the magnetic body was formed by first melt spinning amorphous ribbons and then hot pressing and hot working the body formed from the amorphous ribbons. The hot working temperature is defined to mean the temperature at which both the hot pressing and the die upsetting is accomplished.

The demagnetization curves, as determined by HGM techniques, are illustrated in FIG. 3. Curve "a" represents a hot pressing and hot working temperature of about 1420° F., curve "b"—1400° F., curve "c"—1440° F., curve "d"—1460° F., curve "e"—1480° F., curve "f"—1500° F. and curve "g"—1520° F. The values for remanence ($B_r$) in kiloGauss and coercivity (H) in kiloOersteds for magnetic bodies formed at these various hot working temperatures are summarized below in Table III.

TABLE III

| Temperature (°F.) | $B_r$ | H |
|---|---|---|
| 1520 | 9.2 | 7.8 |
| 1500 | 9.9 | 8.6 |
| 1480 | 11.3 | 9.6 |
| 1460 | 11.8 | 9.8 |
| 1440 | 12.1 | 11.0 |
| 1420 | 12.2 | 12.1 |
| 1400 | 12.3 | 12.8 |

As shown above, the maximum values for magnetic remanence and magnetic coercivity are obtained at a hot working temperature below about 1440° F., preferably about 1400° F., for the preferred alloy of this invention having a carbon addition of about 0.1 weight percent. This hot working temperature is significantly lower than the optimum hot working temperature for the conventional alloy of Comparative Example 5 of about 1520° F.

Also, as illustrated by curve "h" in FIG. 3, magnets containing the preferred addition of about 0.1 weight percent carbon, which are hot pressed only, foregoing the subsequent hot working step intended to plastically deform the grains of the alloy, also show an improvement in magnetic properties as compared to the conventional alloy. The preferred composition, hot pressed at a temperature of about 1460° F. (represented by curve "h"), is characterized by a magnetic remanence of about 8.4 kiloGauss, as compared to a conventional alloy hot pressed at this temperature which is characterized by a magnetic remanence of about 8.0 kiloGauss.

The addition of carbon in small amounts to the conventional neodymium-iron-boron composition reduces the hot working temperatures required for forming anisotropic permanent magnets without a corresponding loss in magnetic properties.

EXAMPLE 7

Melt-spun ribbons of a magnetic alloy having the same composition as the conventional alloy in Comparative Example 1 with an additional 0.15 weight percent tantalum were tested. The nominal composition of this preferred alloy, in weight percentages, was about 30.5 percent rare earth, about 2.5 percent cobalt, about 1.0 percent boron, about 0.15 percent tantalum and a balance of iron. This preferred alloy was again melt spun to form magnetically isotropic ribbons which were annealed at various temperatures to optimize magnetic properties.

The demagnetization curves for these melt-spun ribbons which were annealed at various temperatures formed from the preferred iron-neodymium-boron type magnet composition having 0.15 weight percent tantalum are illustrated in FIG. 4.

In FIG. 4, curve "a" represents an annealing temperature of about 1075° F., curve "b" represents an annealing temperature of about 1112° F., curve "c" represents an annealing temperature of about 1148° F., and curve "d" represents an annealing temperature of about 1184° F. The optimum magnetic properties for the preferred composition having the tantalum addition was determined to occur at an annealing temperature of about 1075° F. (curve "a"). Again, this is not surprising since this is the optimal annealing temperature for the conventional alloy of Comparative Example 1.

Average values for the magnetic properties for the melt-spun ribbons having the tantalum additions, at an annealing temperature of about 1075° F. (curve "a"), are about 7.95 kiloGauss for remanence, 14.1 kiloOersteds for coercivity, and an energy product of about 13.3 MegaGaussOersteds. As compared to the conventional alloy of Comparative Example 1, the remanence of 7.95 kiloGauss (compared to 7.4) and energy product of 13.3 MegaGaussOersteds (compared to 11.5) have improved sufficiently in the preferred alloy while the coercivity of about 14.1 kiloOersteds (compared to 17.5) decreased As stated previously, for many applications all that is required is a high remanence and energy product, so long as the coercivity is sufficient, which is the case with the preferred alloy of this example. If necessary, the coercivity may be increased by suitable heat treatment at a higher temperature, but there may be some slight decrease in energy product and remanence; however, these values would still be higher than for the conventional materials which do not include the carbon or tantalum addition in accordance with this invention.

Tantalum additions preferably should make up no more than about 0.2 weight percent of the alloy composition. Tantalum additions greater than this amount resulted in a decrease in the magnetic properties as compared to the conventional composition. Therefore, it is most preferred to add tantalum in the amount of about 0.1 to about 0.15 weight percent.

EXAMPLE 8

The preferred composition having about 0.15 weight percent tantalum of Example 7 was also hot pressed and hot worked at various temperatures. Generally the magnetic body was formed by first melt spinning amorphous ribbons and then hot pressing and hot working the body formed from the amorphous ribbons.

Figure 5:
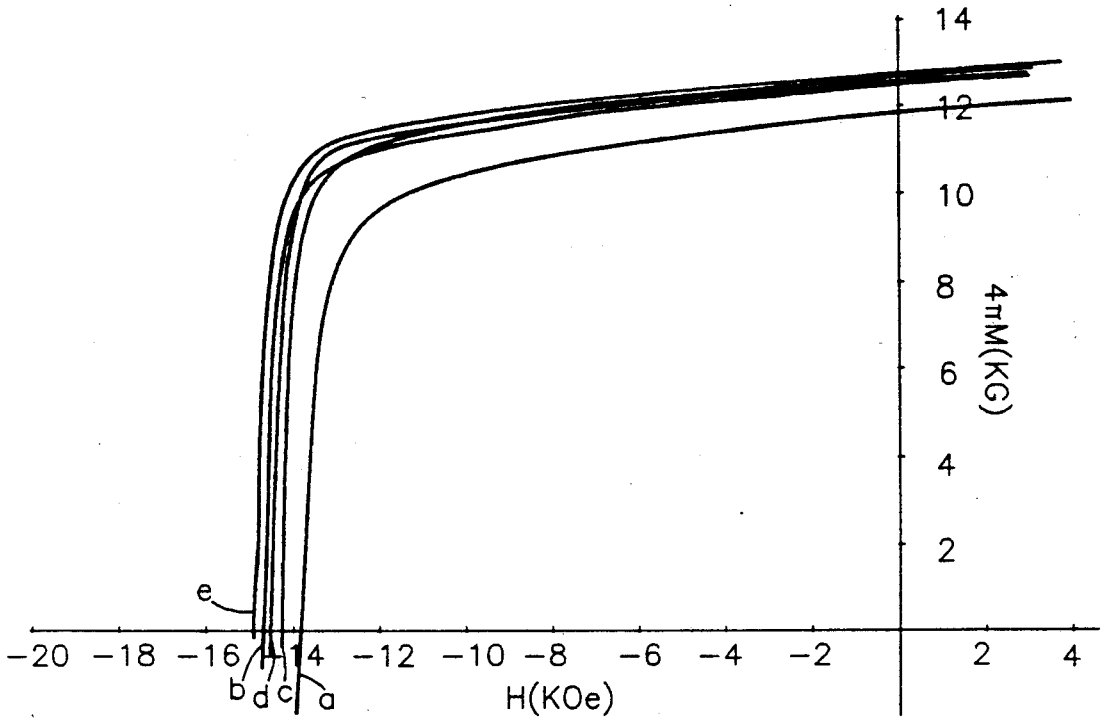
FIG. 5 illustrates demagnetization curves for the iron-neodymium-boron type magnet represented in FIG. 4 which has been hot worked at various temperatures.

The demagnetization curves, as determined by HGM techniques, are illustrated in FIG. 5. Curve "a" represents a hot pressing and hot working temperature of about 1520° F., curve "b"—1420° F., curve "c"—1460° F., curve "d"—1440° F. and curve "e"—1400° F. The values for remanence ($B_r$) in kiloGauss and coercivity (H) in kiloOersteds for the permanent, anisotropic magnetic bodies formed at these various hot working temperatures, as well as the additional hot working temperature of 1480° F. and 1500° F. (which were not included in FIG. 5 for clarity purposes), are summarized below in Table IV.

TABLE IV

| Temperature (°F.) | $B_r$ | H |
|---|---|---|
| 1520 | 11.9 | 13.8 |
| 1500 | 12.3 | 14.2 |
| 1480 | 12.3 | 14.2 |
| 1460 | 12.3 | 14.2 |
| 1440 | 12.3 | 14.3 |
| 1420 | 12.3 | 14.5 |
| 1400 | 12.3 | 14.8 |

As shown above, the maximum values for magnetic remanence and magnetic coercivity are obtained at a temperature below 1500° F., preferably about 1400° F., for the preferred alloy of this invention having a tantalum addition of about 0.15 weight percent. This preferred hot working temperature is significantly lower than the optimum hot working temperature for the conventional hot worked alloy of Comparative Example 5, which was about 1520° F.

Also, magnets containing the preferred addition of about 0.15 weight percent tantalum which were hot pressed only, foregoing the subsequent hot working step that plastically deforms the grains of the alloy, also exhibited an improvement in magnetic properties as compared to the conventional alloy. The preferred composition, hot pressed at a temperature of about 1480° F., was characterized by a magnetic remanence of about 8.3 kiloGauss, as compared to a conventional alloy hot pressed at this temperature which is characterized by a magnetic remanence of about 8.0 kiloGauss.

The addition of tantalum in small amounts to the conventional neodymium-iron-boron composition reduces the hot working temperatures required for forming anisotropic permanent magnets without a corresponding loss in magnetic properties.

The addition of between about 0.1 and 0.15 weight percent carbon or tantalum to the conventional neodymium-iron-boron composition does not cause a loss in the magnetic properties, yet enhances the magnetic remanence and energy product of the melt-spun ribbons, and also permits the hot working of the magnetic bodies at lower temperatures, such as about 100° F. or more below the optimum hot working temperature for the conventional magnetic compositions that do not include the elemental additions.

The preferred compositions necessarily contain iron, neodymium and/or praseodymium, and boron in the preferred amounts specified above, as well as the 0.1 to 0.15 weight percent addition of carbon or tantalum. The composition may also contain other constituents, providing that the anisotropic particles necessarily contain the magnetic phase $RE_2TM_{14}B$ along with at least one additional phase at the grain boundaries that is richer in rare earth. In the essential magnetic phase, TM is preferably at least 60 percent iron and RE is preferably at least 60 percent neodymium and/or praseodymium.

A particularly advantageous feature of this invention is that the addition of about 0.1 to 0.15 weight percent of either carbon or tantalum to the magnetic composition allows the magnetic compositions to be hot worked at a substantially lower temperature than the temperature required to optimize the magnetic properties in a conventional material Generally, the hot working temperature can be reduced by about 100° F. or more without a reduction in the resulting magnetic properties of the composition, which would be expected with conventional compositions The reduced processing temperatures simplify the processing of these types of magnets and also reduce the wear and tear on the machinery employed during the hot working steps.

Therefore, while this invention has been described in terms of a preferred embodiment, it is apparent that other forms could be adopted by one skilled in the art, such as by modifying the composition of the magnetic particles within the preferred weight and atomic ranges, or by substituting different processing steps employed. Accordingly, the scope of this invention is to be limited only by the following claims.

The embodiments of the invention in which an exclusive property or privilege is claimed are defined as follows:

1. A method for forming an anisotropic iron-rare earth metal permanent magnet by hot pressing, at temperatures not greater than about 1450° F, magnetically isotropic particles of an amorphous or finely crystalline material having a grain size less than about 500 nanometers and comprising, on a weight percent basis, about 26 to 32 percent rare earth wherein at least about 90 percent of this constituent is neodymium and the remainder is essentially praseodymium, about 0.7 to about 1.1 percent boron, and the balance being essentially iron wherein cobalt may be substituted for said iron from about 2 to about 16 percent, at a temperature and duration sufficient to produce a fully densified, plastically deformed body having a fine grain microstructure in which the grain size is not greater than about 500 nanometers, and cooling said body, the duration of said hot pressing and rate of cooling being such that the resultant body is magnetically anisotropic and has a coercivity of at least 1,000 Oersteds at room temperature;

wherein the improvement comprises the addition of about 0.1 about 0.15 percent of an elemental additive chosen from the group consisting of carbon and tantalum to the magnetic alloy making up said magnetically isotropic particles, said elemental additive being substantially alloyed with said magnetic alloy;

such that the addition of said carbon or tantalum permits the hot pressing of said magnetically isotropic particles at a reduced temperature of not greater than about 1450° F., while enhancing the magnetic remanence of said hot pressed body, as compared to the hot pressing temperature required for the magnetically isotropic particles not having said elemental additive and the remanence of a magnetic body formed therefrom.

2. A method for forming an anisotropic iron-rare earth metal permanent magnet as recited in claim 1 wherein said magnetically isotropic particles may further comprise gallium in an amount ranging from about 0.55 to about 0.75 weight percent.

3. A method for forming an anisotropic iron-rare earth metal permanent magnet by hot pressing and hot working at temperatures not greater than about 1450° F., comprising the steps of:

hot pressing, at a temperature not greater than about 1450° F., magnetically isotropic particles of an amorphous or finely crystalline magnetic alloy having a grain size less than about 500 nanometers and comprising, on a weight percent basis, about 26 to 32 percent rare earth wherein at least about 90 percent of this constituent is neodymium and the remainder is essentially praseodymium, about 0.7 to about 1.1 percent boron, and the balance being essentially iron wherein cobalt may be substituted for said iron from about 2 to about 16 percent, said magnetic alloy consisting essentially of $Fe_{14}Nd_2B$ tetragonal crystals, at an elevated temperature and pressure for a time sufficient to produce a fully densified body having a fine grain microstructure in which the grain size is no greater than about 500 nanometers;

hot working said fully densified body at a temperature not greater than about 1450° F. to cause plastic flow of at least a portion of the body and to form a fine platelet microstructure having a grain size no greater than about 500 nanometers;

and cooling the body, the duration of hot working and rate of cooling being such that the resultant body is magnetically anisotropic and has a coercivity of at least 1,000 Oersteds at room temperature;

wherein the improvement comprises the addition of about 0.1 to about 0.15 percent of an elemental additive chosen from the group consisting of carbon and tantalum to said magnetic alloy making up said magnetically isotropic particles, said elemental additive being substantially alloyed with said magnetic alloy;

such that the addition of said carbon or tantalum permits the hot pressing and hot working of said magnetically isotropic particles at a reduced temperature of not greater than about 1450° F., while enhancing the magnetic remanence of said body, as compared to the hot pressing and hot working temperature for the magnetically isotropic particles not having said elemental additive and the remanence of a magnetic body formed therefrom.

4. A method for forming an anisotropic iron-rare earth metal permanent magnet as recited in claim 3 wherein said magnetically isotropic particles may further comprise gallium in an amount ranging from about 0.55 to about 0.75 weight percent.

* * * * *